US012305386B2

(12) United States Patent
Pospisil et al.

(10) Patent No.: US 12,305,386 B2
(45) Date of Patent: May 20, 2025

(54) CONSTRAINED LAYER FLOOR AND WALL DAMPING SYSTEMS USING HIGH-DENSITY REINFORCED CEMENT PANELS

(71) Applicant: UNITED STATES GYPSUM COMPANY, Chicago, IL (US)

(72) Inventors: Frank Pospisil, Oak Park, IL (US); Andrew Schmidt, Evanston, IL (US)

(73) Assignee: UNITED STATES GYPSUM COMPANY, Chicago, IL (US)

( * ) Notice: Subject to any disclaimer, the term of this patent is extended or adjusted under 35 U.S.C. 154(b) by 0 days.

(21) Appl. No.: 17/455,166

(22) Filed: Nov. 16, 2021

(65) Prior Publication Data

US 2022/0251828 A1 Aug. 11, 2022

Related U.S. Application Data

(60) Provisional application No. 63/146,095, filed on Feb. 5, 2021.

(51) Int. Cl.
*E04B 1/84* (2006.01)
*E04B 1/82* (2006.01)

(52) U.S. Cl.
CPC ..... *E04B 1/84* (2013.01); *E04B 2001/8263* (2013.01)

(58) Field of Classification Search
CPC .... E04B 1/84; E04B 9/001; E04B 2001/8263; E04F 15/20; E04C 2/04; E04C 2/041; E04C 2/043

(Continued)

(56) References Cited

U.S. PATENT DOCUMENTS 3,284,980 A * 11/1966 Dinkel ..... E04C 2/26 52/367
6,941,720 B2 * 9/2005 DeFord ..... E04C 2/043 52/783.17

(Continued)

FOREIGN PATENT DOCUMENTS

WO WO-2013045602 A2 * 4/2013 ..... B32B 7/12
WO 2019213045 A1 11/2019

OTHER PUBLICATIONS

Durock® Brand, "Cement Board Systems," Material Data Sheet, SA 932 09305, United States Gypsum Company, 2002, 12 pages (Year: 2002).*

(Continued)

*Primary Examiner* — Forrest M Phillips
*Assistant Examiner* — Jennifer B. Olson
(74) *Attorney, Agent, or Firm* — Greer, Burns & Crain, Ltd; Philip T. Petti; Pradip Sahu

(57) ABSTRACT

A method is provided for assembling a wall system to an existing frame for a wall, floor or roof, including: attaching a first dense, fiber-reinforced cement panel to the frame, the panel having an interior surface facing the frame, and an exterior surface; applying a layer of acoustic dampening material is applied to the exterior surface; and attaching a second dense, fiber-reinforced cement panel to at least one of the dampening material, the first panel, and the frame. A building panel is provided, including, a first panel of dense, fiber-reinforced cement; an internal layer of acoustic dampening material; and a second panel of dense, fiber-reinforced cement such that the dampening material is sandwiched between the first and second cement panels.

15 Claims, 4 Drawing Sheets

(58) Field of Classification Search
USPC ..... 181/284, 285, 290
See application file for complete search history.

(56) References Cited

U.S. PATENT DOCUMENTS

| | | | | |
|---|---|---|---|---|
| 6,986,812 | B2 | 1/2006 | Dubey et al. | |
| 7,181,891 | B2 | 2/2007 | Surace et al. | |
| 7,445,738 | B2 | 11/2008 | Dubey et al. | |
| 7,670,520 | B2 | 3/2010 | Dubey et al. | |
| 7,789,645 | B2 | 9/2010 | Dubey et al. | |
| 7,799,410 | B2 | 9/2010 | Tinianov | |
| 8,030,377 | B2 | 10/2011 | Dubey et al. | |
| 8,181,738 | B2 * | 5/2012 | Tinianov | B32B 7/12 181/290 |
| 8,397,864 | B2 * | 3/2013 | Tinianov | E04C 2/043 181/290 |
| 8,424,251 | B1 * | 4/2013 | Tinianov | B32B 37/12 52/144 |
| 9,388,568 | B2 | 7/2016 | Tinianov | |
| 10,066,390 | B2 | 9/2018 | Pospisil et al. | |
| 10,174,499 | B1 | 1/2019 | Tinianov et al. | |
| 10,370,860 | B2 | 8/2019 | Socha | |
| 2010/0261023 | A1 * | 10/2010 | Ravnaas | E04B 1/86 428/521 |
| 2019/0338516 | A1 * | 11/2019 | Ray | B32B 29/02 |

OTHER PUBLICATIONS

PABCO Gypsum, QuietGlue® Pro Datasheet, 2020 (Year: 2020).*
Trademark Soundproofing, How to Soundproof, https://web.archive.org/web/20201111204942/https://www.tmsoundproofing.com/How-to-Soundproof.html, Nov. 11, 2020 (Year: 2020).*
Acoustical Solutions, Green Glue Damping Compound Tubes Technical Data Sheet. Aug. 9, 2016 (Year: 2016).*
Centers for for Disease Control and Prevention (CDC), "Loud Noise Can Cause Hearing Loss"; Internet archive (http://web.archive.org/web/20210124161720/https://www.cdc.gov/nceh/hearing_loss/what_noises_cause_hearing_loss.html) date Jan. 24, 2021. (Year: 2021).*
International Search Report and Written Opinion received for PCT/US2022/070433, mailed May 16, 2022.
Durock® Brand, "Cement Board Systems," Material Data Sheet, SA 932 09305, United States Gypsum Company, 2002, 12 pages.

* cited by examiner

CONSTRAINED LAYER FLOOR AND WALL DAMPING SYSTEMS USING HIGH-DENSITY REINFORCED CEMENT PANELS

RELATED APPLICATION

The present application claims 35 USC 119 priority from U.S. Provisional Application Ser. No. 63/146,095 filed Feb. 5, 2021, the contents of which are incorporated by reference herein.

BACKGROUND

The present invention is generally related to wall systems used in both interior and exterior construction, and more particularly to such wall systems designed for improving the acoustic characteristics of structures. For the purposes of the present discussion, "wall systems" will be understood to refer to floor, roof and ceiling construction as well as walls.

Reducing the amount of noise to which the average person is exposed is emerging as both an economic and public policy issue. Soundproof or sound-reduced (collectively referred to as soundproofing below) rooms or buildings are desired for a variety of purposes. For example, apartments, hotels and schools all often desire rooms with walls, ceilings and floors that significantly reduce the transmission of generated sound to avoid annoying people in adjacent rooms.

Soundproofing is particularly important in buildings adjacent to public transportation, such as highways, airports and railroad lines, as well as in theaters, home theaters, music practice rooms, recording studios and others. One measure of the severity of the problem is the widespread emergence of city building ordinances that specify a minimum Sound Transmission Class ("STC") rating. Another measure is the broad emergence of litigation between homeowners and builders over the issue of unacceptable noise.

Conventional interior walls are made using wood or metal studs with drywall panels on both exterior surfaces of the studs, and baffles of insulation or plates commonly placed between the studs in an attempt to reduce the transmission of sound from one room to the next. Unfortunately, these relatively simple walls have achieved limited success in reducing sound transmission. The excessive sound transmission through such walls has led to apartment tenant complaints, and in some cases, litigation.

Various construction techniques and products have emerged to address the problem of noise control, such as: replacement of wooden framing studs with light gauge steel studs; alternative framing techniques such as staggered-stud and double-stud construction; additional gypsum drywall panel layers; the addition of resilient channels to offset and isolate drywall panels from framing studs; the addition of mass-loaded vinyl barriers; cellulose-based sound board; and the use of cellulose and fiberglass batt insulation in walls not requiring thermal control. All of these changes contribute to reducing the noise transmission, but not to such an extent that certain disturbing noises (e.g., those with significant low frequency content or high sound pressure levels) in a given room are prevented from being transmitted to a room designed for privacy or comfort. The noise may come from rooms above or below the occupied space, or from an outdoor noise source. In fact, several of the above-named techniques only offer a three to six decibel improvement in acoustical performance over that of standard construction techniques, with no regard to acoustical isolation. Such a small improvement represents a just noticeable difference, not a soundproofing solution.

A second concern with the above-named techniques is that each involves the burden of either additional (sometimes costly) construction materials or extra labor expense due to complicated designs and additional assembly steps.

More recently, an alternative building noise control product has been introduced to the market in the form of a laminated damped drywall panel as disclosed in U.S. Pat. No. 7,181,891. That panel, known as a constrained panel, and including a central layer of acoustic dampening material or adhesive sandwiched between conventional wallboard panels, replaces a traditional drywall layer and eliminates the need for additional materials such as resilient channels, mass loaded vinyl barriers, additional stud framing, and additional layers of drywall. The resulting system offers excellent acoustical performance improvements of up to 15 decibels in some cases. However, such systems are susceptible to water damage, and as such are unsuitable for exterior construction, or for use in floors or roofs.

Sound rated or floating floor systems are known for acoustically isolating a room beneath a floor on which impacts may occur, such as pedestrian footfalls, sports activities, dropping of toys, or scraping caused by moving furniture. Impact noise generation can generally be reduced by using thick carpeting, but where vinyl, linoleum, tile, hardwood, wood laminates and other types of hard surfaces including decorated concrete finishes are to be used, a sound rated floor is desirable and required by codes for acoustical separation of multifamily units. The transmission of impact noise to the area below can be reduced by resiliently supporting or acoustically decoupling and/or dampening the underlayment floor away from the floor substructure. The entire floor system contributes to transmitting the noise into the area below. If the floor surface receiving the impact is isolated from the substructure, then the impact sound transmission will be greatly reduced. A dampening material can also reduce transmitted noise. Likewise, if the ceiling below is isolated from the substructure, the impact sound will be restricted from traveling into the area below.

Sound rated walls and floors are typically evaluated by American Society for Testing and Materials (ASTM) Standards E90 for Sound Transmission Class (STC) ratings and E492 with respect to Impact Insulation Class (IIC). The greater the IIC rating, the less impact noise and the less airborne sound will be transmitted to the area below. The International Building Code (IBC) specifies that floor/ceiling installations between units on multi-family buildings must have an IIC rating of not less than 50 and an STC rating of not less than 50. Even though an IIC rating of 50 meets many building codes, experience has shown that in luxury condominium applications, floor-ceiling systems having an IIC of less than 55 may not be acceptable because some impact noise is still audible and considered annoying at those levels.

Sound mats are known for use in flooring systems. A suitable mat is disclosed in U.S. Pat. No. 10,370,860 which is incorporated by reference.

A second figure of merit for the physical characteristics of construction panels are their structural capacities; their flexural and shear strength. Flexural strength refers to the panel's ability to resist breaking when a force is applied to the center of a simply supported panel. Values of flexural strength are given in pounds of force (lbf) or Newtons (N). The measurement technique used to establish the flexural strength of gypsum wallboard or similar construction panels is ASTM C 473-06a "Standard Test Methods for the Physical Testing of Gypsum Panel Products" (publication date Nov. 1, 2006). For floors and roofs the standard that can be used is ASTM E330 (2014) "Standard Test Method for Structural Performance of Exterior Windows, Doors, Skylights and Curtain Walls by Uniform Static Air Pressure Difference." To measure shear capacities in walls ASTM E72 (2015) "Standard Test Methods of Conducting Strength Tests of Panels for Building Construction" or ASTM E2126 (2019) "Standard Test Methods for Cyclic (reversed) Load Test for Shear Resistance of Vertical Elements of the Lateral Force Resisting Systems for Buildings" can be used. To establish floor and roof diaphragm capacities, ASTM E455 (2019) "Standard Test Method for Static Load Testing of Framed Floor or Roof Diaphragm Construction for Buildings" or the AISI TS-7 (2002) "Cantilever Test Method for Cold-Formed Steel Diaphragm" are typically used. These standards are available on the Internet, and it is understood in the art that such standards change over time, but such changes are acknowledged by those skilled in the art. Conventional constrained building panels have been found to have limited flexural and shear strengths.

Thus, it will be seen that there is a need for improved wall systems that reduce the transmission of noise. There is also a need for improved wall systems that focus on the reduction of transmission of low frequency sound.

SUMMARY

The above-listed needs are met or exceeded by the present constrained panel wall system that is designed for either load-bearing or non-load-bearing construction applications of walls, ceilings, roofs and floors. An acoustic dampening material is sandwiched between dense reinforced fiber cement panels to form the present wall system. Due to the enhanced strength of the resulting system, either load-bearing floor, roof or walls are potential construction applications. Additionally, the present wall system is suitable in non-load-bearing system and is usable in any construction where a high-acoustic performance is required, especially where low-frequency noise reduction is a priority.

Provided by the present wall system is a high-STC and IIC floor or wall system including a constrained damping layer sandwiched between reinforced cement panels each having a density of 55 pcf or greater. As a result, the present system attains high airborne and impact sound ratings. In addition, the present system is optionally configured as a load-bearing floor, or a load-bearing or non-load-bearing wall system.

By using two dense fiber reinforced cement panels to sandwich a less-dense material (likely acoustic), the resistive acoustic properties of the system are greatly improved when compared to the sum of the material parts alone. The nature of the configuration of using the high density panels with the lower density constrained (sandwiched) material(s) provide an outstanding acoustic insulation system, which is also able to support applied floor and wall loads. In a preferred embodiment, instead of being provided as a prefabricated panel, the present system is installed or assembled at the jobsite.

In a preferred embodiment, the present system is assembled onsite, using the following steps: to an existing frame for a wall, floor or roof, a first dense, fiber-reinforced cement panel is attached, the panel having an interior surface facing the frame, and an exterior surface; a layer of acoustic dampening material is applied to the exterior surface; a second dense, fiber-reinforced cement panel is attached to at least one of the dampening material, the first panel, and the frame.

In another embodiment, a building panel is provided, including a first panel of dense, fiber-reinforced cement, an internal layer of acoustic dampening material; and a second panel of dense, fiber-reinforced cement such that the dampening material is sandwiched between the first and second cement panels.

In still another embodiment, in a manufacturing facility away from the final building site, a modular structure is constructed using the above-described panels of a dampening material sandwiched between dense, fiber-reinforced cement panels, then the module is shipped to the site where the final building is being erected by stacking and connecting the individual modules. The present constrained system is either preassembled as the modular unit or in pieces to be built/assembled onto the modules.

More specifically, a method is provided for assembling a wall system to an existing frame for a wall, floor or roof, including: attaching a first dense, fiber-reinforced cement panel to the frame, the panel having an interior surface facing the frame, and an exterior surface; applying a layer of acoustic dampening material to the exterior surface; and attaching a second dense, fiber-reinforced cement panel to at least one of the dampening material, the first panel, and the frame.

In an embodiment, the acoustic dampening material is an adhesive, and attaching the second dense, fiber-reinforced cement panel includes inserting at least one fastener into at least one of the first dense, fiber-reinforced cement panel and the frame, then once the acoustic dampening material has set, removing the at least one fastener and patching at least one hole created by the fastener. In an embodiment, applying the acoustic dampening material is accomplished through rolling, brushing, spraying or troweling. Optionally, the acoustic dampening material is provided in sheet form. In another option, some of the fasteners are retained and not removed for retaining the face panel in position.

In an embodiment, the acoustic dampening material is an adhesive including alkyl abietate, a plant resin and polyvinyl alcohol. In another embodiment, the acoustic dampening material is an adhesive applied in a layer of 0.02 inch to 0.10 inch and including a polymer having a glass transition temperature ($T_g$) of −10° C. to about 30° C. It is contemplated that the adhesive further includes plasticizer. In still another embodiment, each of the first and second dense, fiber-reinforced cement panels have a density of 55 pcf or greater.

In another embodiment, a building panel is provided, including, a first panel of dense, fiber-reinforced cement; an internal layer of acoustic dampening material; and a second panel of dense, fiber-reinforced cement such that the dampening material is sandwiched between the first and second cement panels.

DETAILED DESCRIPTION

Figure 1:
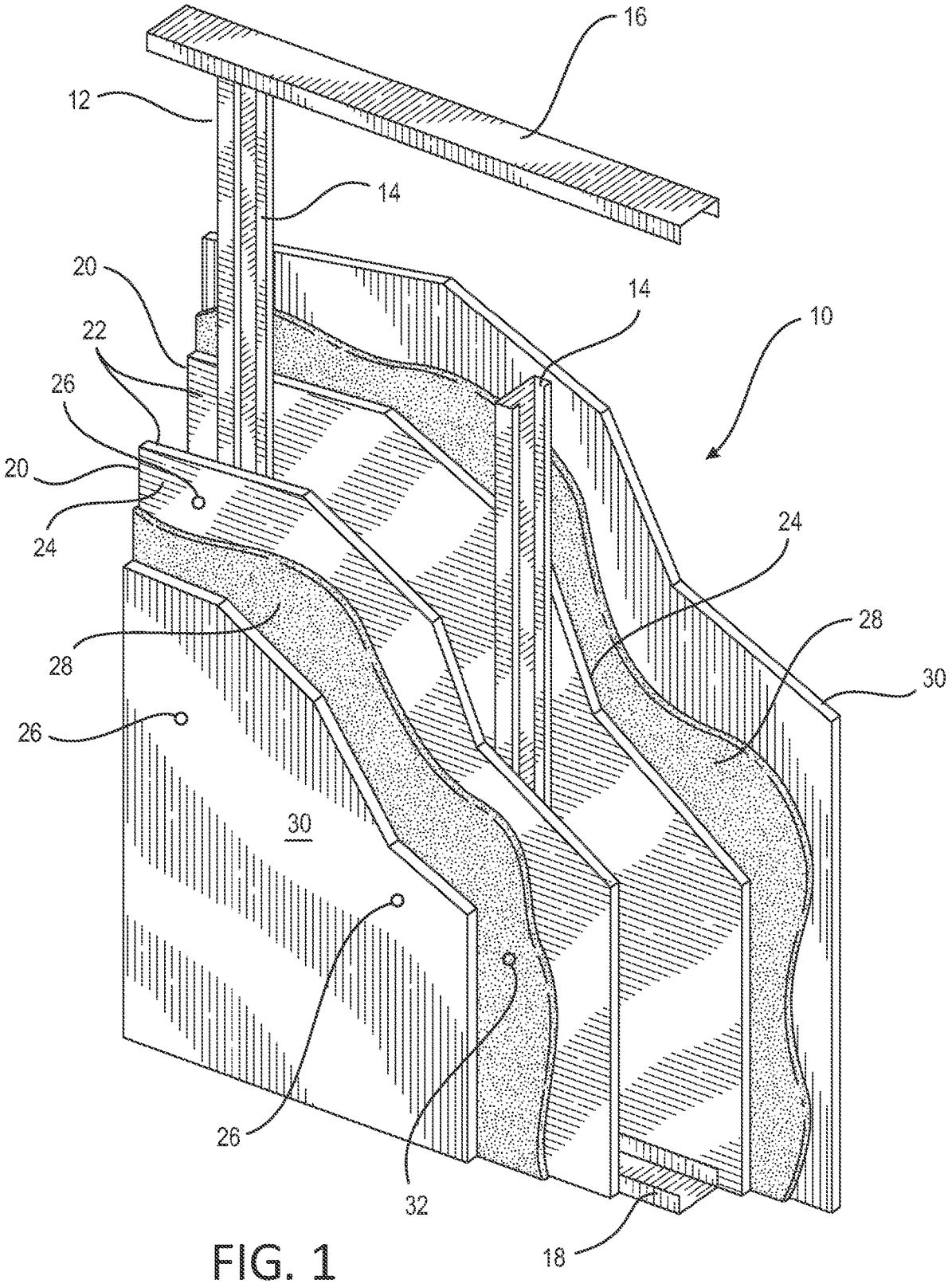
FIG. 1 is a fragmentary view of a wall created using the present wall system, with portions removed for clarity.
Figure 2:
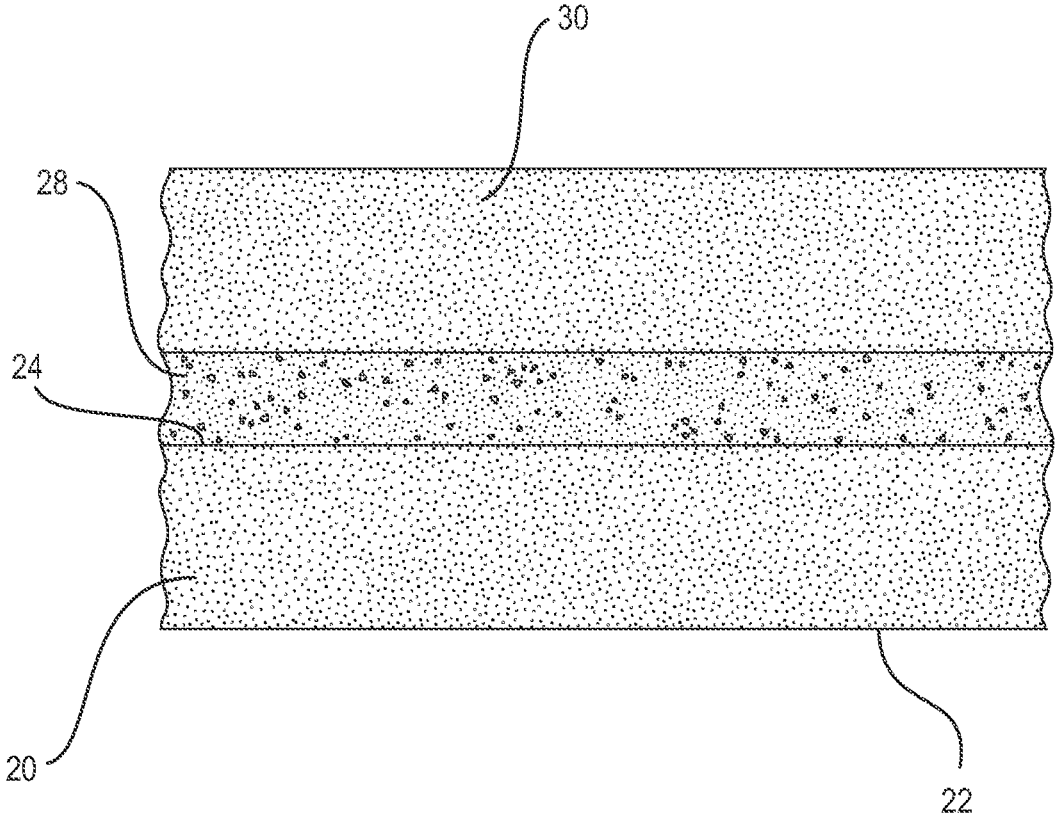
FIG. 2 is a cross-section taken along the line 2-2 of FIG. 1 and in the direction generally designated.

Referring now to FIG. 1, the present sound reducing, constrained layer damping system is shown as a wall panel or generally indicated by reference number 10. For the purposes of the present application, since the same panel is usable in floor, wall, ceiling and roof systems, "wall" will be understood to refer to all such applications. The present system 10 is intended for use on a frame 12 including regularly spaced vertical studs 14 held in place by headers 16 and footers 18 using threaded fasteners or the like as are well known in the art. Also as is well known in the art, the frame 12 is made of wood or metal components. Further, the vertical studs 14 are commonly placed at a 16-inch spacing measured from their center, but may be spaced as far apart as 24-inches.

It is contemplated that the present system 10 is optionally useful in modular construction, whereby the present system either arrives pre-assembled as panels at a modular manufacturing facility, or as components which are then mounted onto the individual building modules. These modules are then completed and transported to an installation site, where they are stacked and connected to each other and then form the final modular building. It is also contemplated that the modular manufacturing site can be on the construction site or at a remote assembly location. Such modular construction is described in commonly-assigned U.S. Pat. No. 10,066,390 which is incorporated by reference.

Included in the damping system 10 is a first dense, fiber-reinforced, structural cementitious panel 20 as described in U.S. Pat. Nos. 6,986,812; 7,445,738; 7,670,520; 7,789,645; and 8,030,377, which are all incorporated herein by reference. It is also contemplated that the term "fiber-reinforced, structural cementitious panel" also refers to Portland cement-based, Magnesium Oxide cement-based and polymer cement-based panels. The first panel 20 has an interior surface 22 facing the frame 12, and an exterior surface 24. As is known in the art, the first panel 20 is secured to the frame 12 using fasteners 26. It is preferred that the first panel 20 has a density of at least 55 pounds per cubic foot (pcf). It is further preferred that the first panel 20 has a density of at least 80 pcf.

Applied to the exterior surface 24 is an acoustic dampening material 28 contemplated has having a wide range of compositions, but being resilient and absorbing sound waves. The dampening material 28 is optionally provided as an adhesive-like composition or as a sheet of material, and is also referred to as the adhesive 28 as a coating or a layer. When the former is utilized, the acoustic dampening material 28 is applied to the exterior surface 24 using a roller, a brush, a trowel, or is sprayed upon the panel 20 using conventional spraying equipment. When provided as a sheet of material, the dampening material 28 is secured to the panel 20 using fasteners 26 or adhesive. In the preferred embodiment, the dampening material 28 is applied in a thickness of 0.02 inch to 0.10 inch.

A second dense, fiber-reinforced, structural cementitious panel 30, preferably identical to the first panel 20, is applied to the dampening material 28 so that that dampening material is sandwiched between the panels 20, 30. In the preferred embodiment, the second panel 30 is attached to at least one of the dampening material 28, the first panel 20, and the frame 12.

By using two dense fiber reinforced cement panels 20, 30 to sandwich the less-dense acoustic dampening material 28, the resistive acoustic properties of the system 10 are greatly improved when compared to the sum of the material parts alone. The nature of the configuration of using the high density panels 20, 30 with the lower density constrained (sandwiched) material 28 provides the present acoustic insulation system 10, which is also able to support applied floor and wall loads. In a preferred embodiment, instead of being provided as a prefabricated panel, the present system 10 is installed or assembled at the jobsite.

In applications where the acoustic dampening material 28 is a settable adhesive, attaching the second dense, fiber-reinforced cement panel 30 includes inserting at least one fastener 32 into at least one of the first dense, fiber-reinforced cement panel 20 and the frame 12. Then, once the acoustic dampening material 28 has set, the fasteners 32 are removed and the resulting holes are patched as is well known in the art.

In applications where the dampening layer 28 is an adhesive, the adhesive layer includes a polymer such as a binder. A suitable adhesive 28 is disclosed in commonly-assigned U.S. patent application Ser. No. 16,356,303, filed Mar. 18, 2019, US 2019/0338516 which is incorporated by reference. The adhesive layer preferably has a balance between tackiness and relaxation time. That is, the adhesive should be pliable and tacky enough to adhere to both the panels 20 and 30. Concurrently, sound dampening is improved with a high viscoelastic relaxation time. That is, the velocity of sound depends on the elastic modulus of the adhesive ($\check{E}(\omega)$). $\check{E}(\omega)$ can be expressed as $\check{E}(\omega)=E'(\omega)+iE''(\omega)$, where $E'(\omega)$ is the storage modulus and $E''(\omega)$ is the loss modulus of the adhesive and each can be expressed as EQ. 1 and EQ. 2, where $\omega$ is frequency (for STC $\omega$ ranges from 100-5000 Hz) and $\Theta$. is the viscoelastic relaxation time of the adhesive.

$$E'(\omega) = \frac{E}{1+(\omega\theta)^2} \quad \text{EQ. 1}$$

$$E''(\omega) = E * \frac{\omega\theta}{1+(\omega\theta)^2} \quad \text{EQ. 2}$$

Accordingly, $$\frac{E''(\omega)}{E'(\omega)} = \omega\theta.$$

Therefore, for a high $\theta$, the loss modulus is higher as compared to the storage modulus. So, when $E''(\omega)$ is greater than $E'(\omega)$, the acoustic attenuation in transmission increases. In addition, the adhesive preferably should maintain high viscoelastic relaxation time over time and a range of temperatures.

In a preferred embodiment, the polymer of the adhesive layer 28 is synthetic latex (i.e., an aqueous dispersion of polymer particles prepared by emulsion polymerization of one or more monomers). The latex is a film-forming polymer. The adhesive coating used to form the adhesive layer comprises an aqueous emulsion or dispersion comprising water, surfactant, and latex polymer selected from the group consisting of acrylics, styrene acrylics, acrylic esters, vinyl acrylics, vinyl chloride acrylic, styrene acetate acrylics, butyl acrylics, ethyl acrylics, ethylene polyvinyl acetate, polyvinyl acetate, styrene butadiene, and combinations thereof. If desired, the adhesive coating can have an absence of one or more of the foregoing polymers. Typical acrylics are polymers made from polymers of acrylic acid or acrylates, for example, polyacrylate, poly butyl acrylate, poly ethyl acrylate.

Preferably the latex polymer is selected from styrene-butadiene latex, styrene acrylic polymer, or acrylic ester polymer. Preferably, the latex polymer glass transition temperature is in the range from about −10° C. to about 30° C., more preferably from about 5° C. to about 30° C., more preferably from about −10° C. to about 20° C., and more preferably from about 10° C. to about 20° C.

Typically, the adhesive compositions 28 have at least 10 wt. %, more typically at least 20 wt. % latex polymer. For example, typically 15 to 70 wt. %, 45 to 70 wt. % or 45 to 60 wt. % latex polymer.

The adhesive compositions 28 may also include a plasticizer. Typically, the adhesive compositions 28 have 0 to 50 wt. % more typically 5 to 50 wt. %, furthermore typically 10 to 30 wt. % plasticizer. However, the adhesive compositions of the invention may have an absence of plasticizer.

Typical plasticizers may be any of abietates, phthalates, terephthalates, benzoates, and epoxidized oils such as epoxidized soybean oil (ESO), preferably the abietates.

The plasticizer improves both tack and sound attenuation. The term "tack" refers to the ability of a material to stick to the surface on momentary contact and then to resist separation.

Typical abietates are alkyl abietate, e.g., methyl abietate or ethyl abietate, or aralkyl abietate, for example benzyl abietate. The abietate is believed to work like a plasticizer and can be used to adjust the softness and tackiness of the adhesive.

The alkyl portion of the alkyl abietate can be a saturated linear or branched $C_1$ to $C_{16}$, preferably $C_1$ to $C_8$, alkyl group. The aralkyl group is typically benzyl.

Typical abietate plasticizers for use in the present invention are shown in Formula (I).

(I)

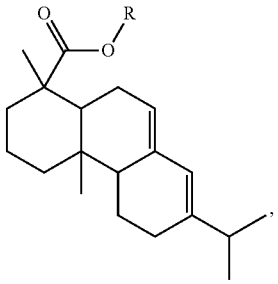

wherein R is a saturated linear or branched $C_1$ to $C_{18}$, typically $C_1$ to $C_{16}$ or $C_1$ to $C_8$ or $C_1$ to $C_4$, alkyl group or an aralkyl group, preferably benzyl.

A representative of the alkyl abietate family, methyl abietate, is shown in Formula (II).

(II)

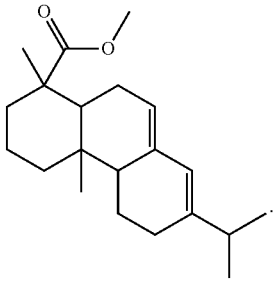

Another representative of the alkyl abietate family, hexadecyl ester of abietic acid (i.e., cetyl abietate), is shown in Formula (III).

(III)

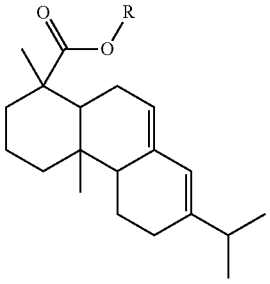

wherein R is a linear alkyl group having the formula $C_{16}H_{33}$.

The adhesive compositions 28 also optionally include a resin. Typical resins may be any one or more synthetic resins. Typical resins may include any one or more plant resins. For example, typically one or more plant resins such as wood or gum rosin, ester gum, hydrogenated rosin, dammar gum, manila gum, coumarone-indene resin, copal, kauri gum, ethyl cellulose, mastic, and/or sandarac.

Typically, the adhesive compositions 28 have 0 to 25 wt. %, more typically 5 to 20 wt. % resin. However, the adhesive 28 is contemplated has having an absence of resin.

The adhesive compositions 28 also optionally include a polyvinyl alcohol.

Typically, the adhesive compositions 28 have 0 to 20 wt. %, more typically 5 to 15 wt. % poly vinyl alcohol. However, the adhesive compositions 28 optionally have an absence of polyvinyl alcohol.

A preferred adhesive composition 28 for achieving a balance of properties comprises the above-described polymer and a plasticizer, preferably an alkyl or aralkyl abietate plasticizer.

A more preferred adhesive composition 28 includes a mixture of acrylic polymer, resin, polyvinyl alcohol and alkyl abietate. The acrylic component, resin, and polyvinyl alcohol can provide tack. Further, the hydrogel nature of polyvinyl alcohol also allows it to retain some water in it, which helps with workability and reduction sound transmission of the adhesive.

To improve the workability, different inorganic components (e.g., calcium carbonate, anhydrous gypsum, etc.) can be also included.

If desired particles of sound compliant material and particles of sound-stiff material can also be included in the polymer adhesive layer 28. Such a polymer adhesive layer 28 includes the polymer adhesive as binder and a combination of first particles (the particles of sound compliant material) which are mostly compliant with respect to sound transmission and second particles (the particles of sound-stiff material) which are mostly stiff with respect to sound transmission.

It will be appreciated that the term "compliant material" is used interchangeably with the term "sound-compliant material" and it is understood broadly in this disclosure to mean a material which is at least partially flexible and able to transfer, dissipate and/or absorb sound waves through its body at least partially. It will be further appreciated that the term "stiff material" is used interchangeably with the term "sound-stiff material" and is understood broadly in this disclosure to mean any material which is likely to reflect most of energy from sound waves rather than transfer, dissipate and/or absorb the sound waves.

If desired, the sound-compliant particles are larger in size than sound-stiff particles such that each sound-compliant particle is surrounded with several sound-stiff particles. In other embodiments, sound-compliant particles and sound-stiff particles are of about same size. If desired, the sound-compliant particles and sound-stiff particles are used in the equal molar ratios. However, if desired the sound-compliant particles are the main component and sound-stiff particles are used in only much smaller amounts. In other embodiments, this ratio is reversed. For example, the molar ratio of sound-compliant particles to sound-stiff particles in the compliant coating may be from 1:1 to 1:1,000 or the molar ratio of sound-compliant particles to sound-stiff particles is 1,000:1 to 1:1.

If desired, the polymer adhesive layer 28 includes sound-compliant rubber particles, such as for example tire scrap particles, with sound-stiff nanometric silica particles. It will be further appreciated that any sound-compliant particles are optionally used, including, but not limited to, nitrile rubber, butyl rubber, ethylene propylene diene monomer (EPDM), natural rubber compounds, cotton fibers, organic fibers, inorganic fibers, polypropylene fibers, air-filled glass beads, polystyrene beads or polystyrene foam.

It will be also appreciated that any sound-stiff particles are usable in the compliant coating 28. Such sound-stiff particles may include, but are not limited to, silica particles, clay particles, calcium carbonate, perlite, gas-filled microspheres, hollow microspheres, cenospheres and inorganic glues. If desired, a combination of several sound-compliant materials can be mixed together with at least one sound-stiff material. If desired, a combination of several sound-stiff materials can be mixed together with at least one sound-compliant material. If desired, a combination of several sound-stiff materials can be mixed together with several sound-compliant materials.

However, without being limited by theory, sound has a higher transmission velocity through solid particulates. Therefore, to create the sharp discontinuity in velocity of sound at the different layers, the adhesive layer 28 preferably does not include solid particulates. Generally, the polymer adhesive layer 28 has an absence of mineral filler. Generally, the polymer adhesive layer 28 has an absence of gypsum. Generally, the polymer adhesive coating 28 applied has an absence of gypsum. Generally, the polymer adhesive coating 28 applied has an absence of calcium carbonate. Generally, the polymer adhesive coating 28 applied has an absence of magnesium carbonate. Generally, the polymer adhesive coating 28 applied has an absence of pigment. Generally, the polymer adhesive coating 28 applied has an absence of polyurea. Generally, the polymer adhesive coating 28 applied has an absence of inorganic particles. Generally, the polymer adhesive coating 28 applied has an absence of organic particles.

Generally, the polymer adhesive coating 28 applied has an absence of hydroxyethyl cellulose.

Generally, the adhesive layer 28 is applied in an amount equal to that to form a polymer coating having a thickness of about 0.02 inches to about 0.06 inches, a thickness of about 0.02 inches to about 0.05 inches.

In one embodiment, the adhesive layer 28 is applied by at least one method selected from the group consisting of spray coating, dip coating, rill application, free jet application, blade metering, rod metering, metered film press coating, air knife coating, curtain coating, flexography printing, and roll coating.

Methods for preparing synthetic latexes are well known in the art and any of these procedures can be used. Latexes typically have 1-55 wt. % binder (polymer) and water. Latex is an emulsion with emulsified polymer particles that can vary from 30 nm to 1500 nm. Therefore, the adhesive coating can comprise the emulsified polymer particles with an absence of other particles including solid particles, for example filler particles. Once the adhesive coating is applied and is the adhesive layer in the final inventive product, the latex forms a film (e.g., a continuous film) and is not in particulate form. Therefore, the adhesive layer can have an absence of particulates.

Figure 3:
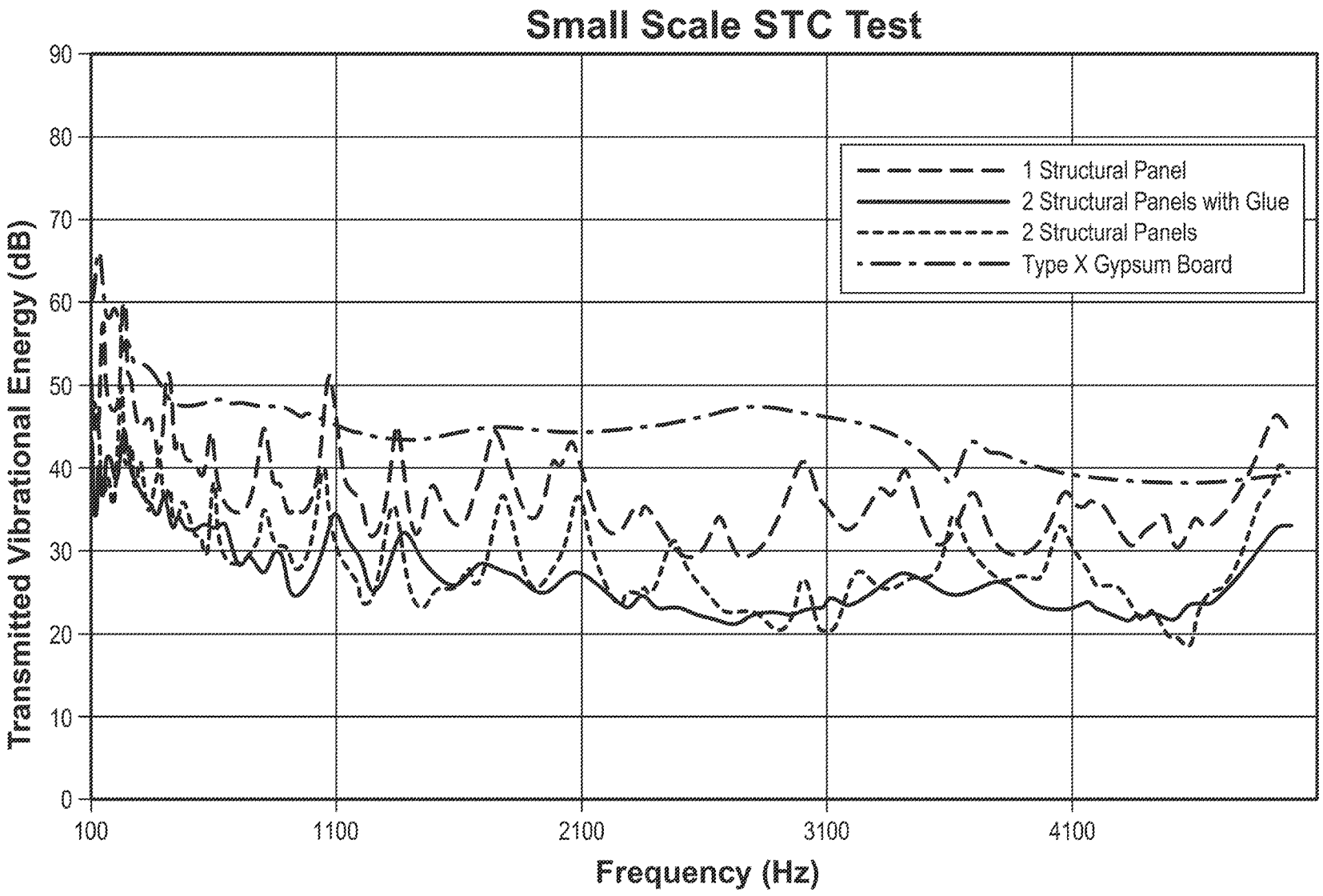
FIG. 3 is a graphic representative of test data where sound absorption at various frequencies of several panel systems was compared.
Figure 4:
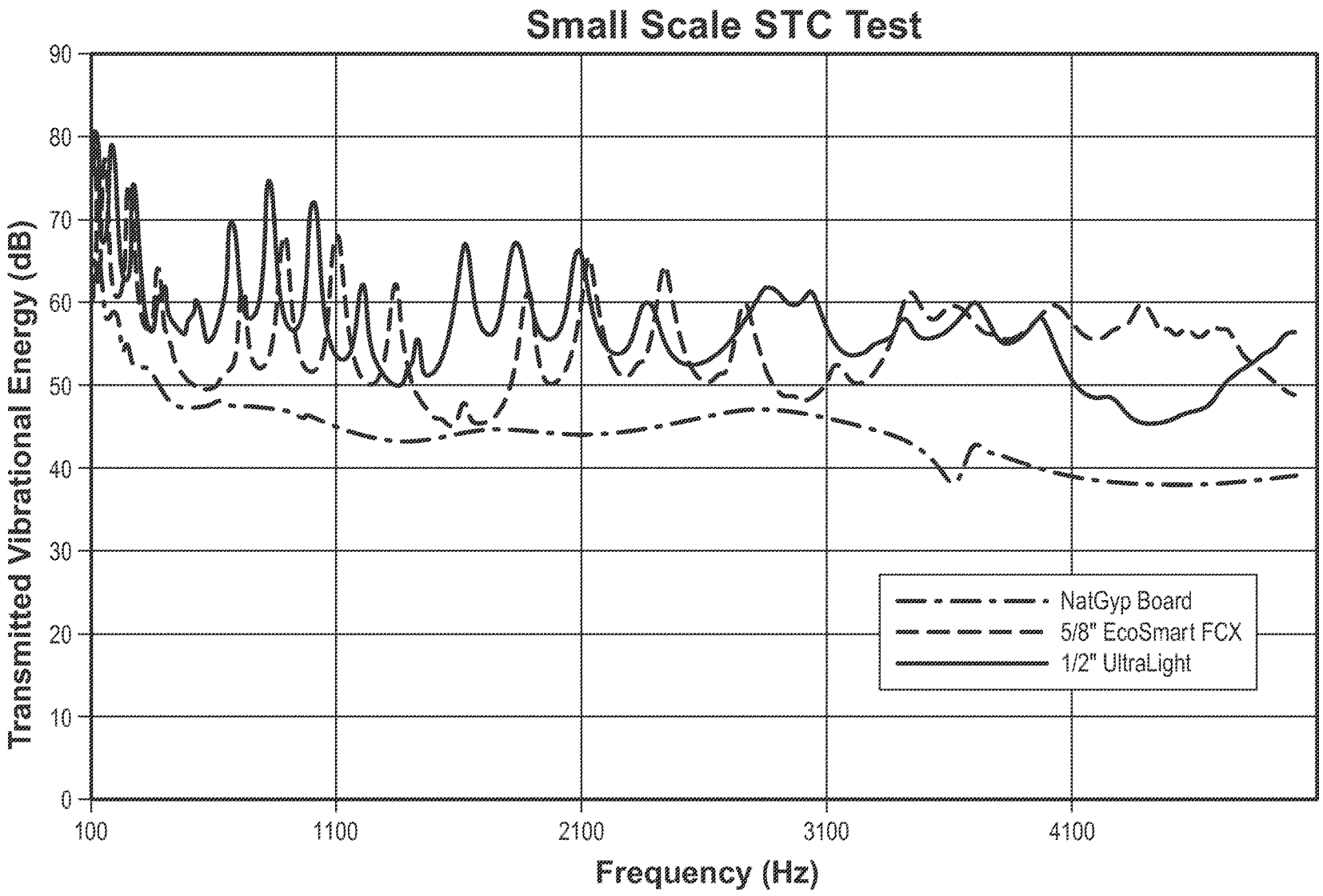

Referring now to FIG. 3, test results of a small scale STC test are shown. The small scale test method was a table-top arrangement: A material sample (gypsum wallboard or other panel), with approximate dimensions of 4" wide by 48" long, is held in place on each of long ends of the sample by silicone rubber padded clamps to mitigate undesirable vibrations. An electrodynamic shaker is placed upon vibration isolation pads and securely fastened to the table. An impedance head is attached to the shaker to measure the input force (frequency and amplitude), which will be used to normalize the frequency response function. The shaker is attached to the material sample at one end and is excited with a random noise signal ranging from 100 to 4000 Hz. Micro-accelerometers are attached equidistant points along the length of the material sample and are used to measure the frequency response function at the equidistant points along the material sample. The output frequency response function (frequency and amplitude) measured by the accelerometers is compared to the input frequency response function (frequency and amplitude) measured by the impedance head at the shaker. The difference between these input and output frequency responses is then correlated to acoustic transmission loss of the material sample.

Referring again to FIG. 3, it is seen that the preferred constriction of structural panels 20, 30 sandwiching a layer of adhesive 28, shown as Structural Panels with Glue, provided superior sound reduction results at all frequencies compared to a single structural panel alone, a pair of structural panes or conventional gypsum wallboard (Type X Gypsum Board).

While a particular embodiment of the present constrained layer floor and wall damping systems using high-density reinforced cement panels has been described herein, it will be appreciated by those skilled in the art that changes and modifications may be made thereto without departing from the invention in its broader aspects and as set forth in the following claims.

The invention claimed is:

1. A method for assembling a wall system to an existing frame for a wall, floor or roof, comprising:

attaching a first dense, fiber-reinforced cement panel to the frame, the first panel having an interior surface facing the frame, and an exterior surface, wherein the first panel has a density of at least 80 pcf;

applying an uninterrupted layer of acoustic dampening material uniformly to the exterior surface, wherein said acoustic dampening material is an adhesive including alkyl abietate and sound-compliant rubber particles; and attaching a second dense, fiber-reinforced cement panel to at least one of the dampening material, the first panel, and the frame, wherein said wall system reduces the transmitted vibrational energy of sounds which have a frequency between 2100 Hz and 4100 Hz below 30 decibels.

2. The method of claim 1, wherein attaching the second dense, fiber-reinforced cement panel includes inserting at least one fastener into at least one of the first dense, fiber-reinforced cement panel and the frame, then once the acoustic dampening material has set, removing the at least one fastener and patching at least one hole created by the fastener.

3. The method of claim 1, wherein said acoustic dampening material is provided in sheet form.

4. The method of claim 1, wherein applying said acoustic dampening material is accomplished through rolling, brushing, spraying or troweling.

5. The method of claim 1, wherein said acoustic dampening material is applied in a layer of 0.02 inch to 0.10 inch and including a polymer having a glass transition temperature ($T_g$) of −10° C. to about 30° C.

6. The method of claim 5, wherein said adhesive further includes plasticizer.

7. The method of claim 1, wherein said second dense, fiber-reinforced cement panel has a density of 55 pcf or greater.

8. The method of claim 1, wherein a density of said acoustic dampening material is less than a density of said first and second cement panels and wherein said wall system effectively reduces the transmitted vibrational energy of sounds which have a frequency above 500 Hz.

9. A building panel, comprising:

a first panel of dense, fiber-reinforced cement, wherein the first panel has a density of at least 80 pcf;

an internal layer of acoustic dampening material, wherein said acoustic dampening material is an adhesive including alkyl abietate, and wherein said acoustic dampening material includes a latex polymer with a glass transition temperature in the range of about 5° C. to about 30° C., provided between 45 to 70 weight percent of the acoustic dampening material; and a second panel of dense, fiber-reinforced cement such that said dampening material is sandwiched between said first and second cement panels, wherein a density of said acoustic dampening material is less than a density of said first and second cement panels and wherein said building panel reduces the transmitted vibrational energy of sounds which have a frequency between 2100 Hz and 4100 Hz below 30 decibels.

10. The building panel of claim 9, wherein said fiber reinforced cement panel includes one of portland cement based, magnesium oxide cement based and polymer cement based panels.

11. The building panel of claim 9, wherein said layer acoustic dampening material is applied uniformly as an uninterrupted layer or said second panel a density of 55 pcf or greater.

12. A sound reducing wall, comprising:

a frame comprising regularly spaced vertical studs held in place by headers and footers;

a first panel of dense, fiber-reinforced cement, which includes an interior surface secured to said frame, wherein the first panel has a density of at least 80 pcf;

an internal layer of acoustic dampening material, wherein said acoustic dampening material is an adhesive and wherein said acoustic dampening material has an absence of organic particles; and a second panel of dense, fiber-reinforced cement such that said dampening material is sandwiched between said first and second cement panels, wherein said sound reducing wall reduces the transmitted vibrational energy of sounds which have a frequency between 2100 Hz and 4100 Hz below 30 decibels.

13. The sound reducing wall of claim 12, wherein said layer acoustic dampening material is applied uniformly as an uninterrupted layer or said second panel has a density of 55 pcf or greater.

14. The sound reducing wall of claim 12, wherein a density of said acoustic dampening material is less than a density of said first and second cement panels and wherein said sound reducing wall effectively reduces the transmitted vibrational energy of sounds which have a frequency above 500 Hz.

15. The sound reducing wall of claim 12, wherein said fiber reinforced cement panel includes one of portland cement based, magnesium oxide cement based and polymer cement based panels.

* * * * *